US008786388B2

(12) United States Patent
Ramezanian et al.

(10) Patent No.: US 8,786,388 B2
(45) Date of Patent: Jul. 22, 2014

(54) ELECTROMAGNETIC SWITCH FOR A STARTING DEVICE, AND METHOD FOR SWITCHING THE ELECTROMAGNETIC SWITCH

(75) Inventors: Houman Ramezanian, Ennetbaden (CH); Claus Kramer, Besigheim (DE); Michael Froehlich-Schlapp, Rheinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/126,298

(22) PCT Filed: Oct. 27, 2009

(86) PCT No.: PCT/EP2009/064153
§ 371 (c)(1),
(2), (4) Date: Jul. 26, 2011

(87) PCT Pub. No.: WO2010/049421
PCT Pub. Date: May 6, 2010

(65) Prior Publication Data

US 2011/0279202 A1 Nov. 17, 2011

(30) Foreign Application Priority Data

Oct. 27, 2008 (DE) ..... 10 2008 043 186

(51) Int. Cl.
*H01H 1/00* (2006.01)
*H01H 67/02* (2006.01)
*H01H 50/54* (2006.01)
*H01H 50/60* (2006.01)

(52) U.S. Cl.
CPC ..... *H01H 50/54* (2013.01); *H01H 50/546* (2013.01); *H01H 50/60* (2013.01)
USPC ..... 335/196; 335/126; 335/131; 335/133

(58) Field of Classification Search
USPC ..... 335/196, 133, 126, 131
See application file for complete search history.

(56) References Cited

U.S. PATENT DOCUMENTS

| | | | | | |
|---|---|---|---|---|---|
| 1,238,667 | A | * | 8/1917 | Halbleib et al. | 335/187 |
| 1,563,670 | A | * | 12/1925 | Spencer | 335/261 |
| 1,803,908 | A | * | 5/1931 | Lansing | 335/187 |
| 3,272,949 | A | * | 9/1966 | Lawrence | 200/243 |
| 4,987,396 | A | | 1/1991 | Bogner | |
| 5,021,760 | A | | 6/1991 | Krubsack et al. | |
| 5,424,700 | A | * | 6/1995 | Santarelli | 335/126 |
| 5,481,236 | A | * | 1/1996 | Ruehle et al. | 335/126 |
| 5,548,260 | A | * | 8/1996 | Kogure et al. | 335/126 |
| 5,757,256 | A | * | 5/1998 | Vilou | 335/126 |
| 6,180,899 | B1 | | 1/2001 | Passow | |
| 7,598,831 | B2 | * | 10/2009 | Braun et al. | 335/196 |
| 7,843,289 | B1 | * | 11/2010 | Raklyar et al. | 335/4 |

FOREIGN PATENT DOCUMENTS

| | | | |
|---|---|---|---|
| DE | 323187 | | 7/1920 |
| DE | 1003318 | | 2/1957 |
| DE | 3233858 | | 3/1984 |
| DE | 19549179 | | 7/1997 |
| DE | 69612945 | | 9/2001 |
| DE | 102004017159 | | 10/2005 |
| DE | 102004017160 | | 10/2005 |
| DE | 202007012098 | | 2/2008 |
| EP | 0257205 | | 3/1988 |
| EP | 0291895 | | 11/1988 |
| FR | 2861891 | | 5/2005 |
| FR | 2861891 | A1 * | 5/2005 |
| GB | 2277834 | | 9/1994 |
| JP | 39-5251 | | 3/1964 |
| JP | 53139550 | | 12/1978 |
| JP | 54-86675 | | 6/1979 |
| JP | 54-88563 | | 6/1979 |
| JP | 61185830 | A * | 8/1986 |
| JP | 2004335436 | | 11/2004 |

OTHER PUBLICATIONS

PCT/EP2009/064153 International Search Report.

* cited by examiner

*Primary Examiner* — Mohamed Musleh
(74) *Attorney, Agent, or Firm* — Michael Best & Friedrich LLP

(57) ABSTRACT

The invention relates to an electromagnetic switch (16) for a starting device (10), comprising two contacts (180, 181) that are electroconductively inter-connected by a mobile contact bridge (184). At least one of the two contacts (180, 181) preferably comprises a contact surface (300) fixed to a contact stud (150, 151). According to the invention, a) the contact surface (300) is at least essentially flat, and an edge (279) of the contact bridge (180, 181), is arranged in such a way that, (184), providing electrical contact between the contact bridge (184) and the contact once it has come into contact with the contact surface (300), it enables a linear contact between the contact (189, 181) and the contact bridge (184), or b) the contact surface (300) comprises bumps lying essentially in one plane, and an edge (279) of the contact bridge (184), providing electrical contact between the contact bridge (184) and the contact (180, 181), is arranged in such a way that, once it comes into contact with the contact surface (300), it enables essentially a multiple-point contact between the contact (180, 181) and the contact bridge (184), or c) a surface (318) of the contact bridge (184), oriented towards the contact (180, 181), and a longitudinal axis (312) of the contact stud (150, 151), form an angle (β) oriented towards a central axis (315) of the switch (16) and larger than 90°, or d) a surface (318) of the contact bridge (184), oriented towards the contact (180, 181), and a longitudinal axis (312) of the contact stud (150, 151), form an angle (β) which is radially outwardly oriented towards a central axis (315) of the switch (16) and is larger than 90°. The invention also relates to a method for switching an electromagnetic switch, preferably a starting device (10), comprising two contacts (180, 181) that are connected by a mobile contact bridge (184). When the contact bridge (184) is contacted by at least one of the two contacts (180, 181), a rubbing movement is generated between the contact bridge (184) and the contact surface (300) of the contact (180, 181).

6 Claims, 8 Drawing Sheets

ELECTROMAGNETIC SWITCH FOR A STARTING DEVICE, AND METHOD FOR SWITCHING THE ELECTROMAGNETIC SWITCH

BACKGROUND OF THE INVENTION

The invention relates to an electromagnetic switch for a starting device and to a method for operating the electromagnetic switch.

The German laid-open specification DE 195 49 179 A1 has disclosed an electromagnetic switch (starter relay) for a starting device. This switch has two contacts which are referred to as contact pins in said document. The two contacts are electrically conductively connected to one another by a movable contact link in order to conduct current from the contact pin, which is connected to a positive terminal or a starter battery, to a contact pin and thereby conduct electrical potential to a starter motor, which is not shown in any more detail in said document. DE 10 2004 017 160 A1 has disclosed a further relay for starting devices. This relay has a so-called self-sprung contact link, in which a transverse force is produced between the contact link or the surface thereof and the mating contacts once contact has been made between the contact link and the mating contacts owing to the elasticity of the contact link.

SUMMARY OF THE INVENTION

The intention is to improve further the contact-making between the contact link and the mating contacts in comparison with this prior art.

The proposed solutions attempt to produce a scraping movement between the two contact-making surfaces between the contact surface of the contacts and the surface of the contact link and thereby to remove dirt and such like by means of the switching movement. All of the first four alternatives have the common factor that the electromagnetic switch has two contacts, which are electrically conductively connected to one another by a movable contact link. Said alternatives have the further common feature that the at least one contact has a contact surface. The first alternative provides for the contact surface to be at least substantially planar and for an edge of the contact link, said edge making electrical contact between the contact link and the contact, to be arranged in such a way that, once said edge has impinged upon the contact surface, it enables substantially linear touching contact between the contact and the contact link. This has the advantage that, in comparison with the previously known solutions, a comparatively high contact pressure between the two contact-making elements can be achieved. This is a precondition for a high-quality cleaning effect between the contact faces and for a scraping effect between the contact link and the contact surface which is as good as possible.

The second alternative provides for at least point touching contact between the contact and the contact link to be achieved. For this purpose, provision is made for the contact surface of the contact to have elevations, the highest regions of which lie substantially on one plane. An electrical contact between the contact link and the contact-making edge of the contact link is arranged in such a way that, once said edge has impinged upon the contact surface, it enables substantially at least point touching contact between the contact and the contact link.

Substantially "linear touching contact" and substantially "point touching contact" means that the contact-making contact faces between the contact link and the contact are very narrow and comparatively long in the event of a substantially linear touching contact. A point touching contact means that the current passage area between the contact link and the contact is reduced to at least one, possibly a plurality of, very small area(s) which is virtually a point.

The third alternative provides that a face of the contact link, said face pointing towards the contact, and an axis of a contact pin enclose between them an angle which points towards a central axis of the switch and is greater than 90°. This definition applies, for example, to the rest position of the electromagnetic switch.

A fourth alternative describes that a face of the contact link, said face pointing towards the contact, and an axis of the contact pin enclose between them an angle which points radially outwards with respect to a central axis of the switch and is greater than 90°. This definition also preferably applies to the rest position of the electromagnetic switch.

The central axis of the switch can be considered to be, for example, the axis around which, for example, a pull-in winding or a hold-in winding of the electromagnetic switch is wound. This axis is generally also equivalent to the central axis of a magnet core of the electromagnetic switch.

In accordance with the alternatives, it is possible to reduce the bounce of the contact link as it impinges on the contacts to be connected since the friction between the contact partners is produced during contact-making. This results in a reduction in the tendency to arc and therefore in a reduction in the surface temperatures of the contact and the contact link. As a result, the wear on the contact link and also the contact is reduced since there is less arc erosion. For the very rare case of cohesive connections, said alternatives enable an additional transverse force onto the respective connection, with the result that, in the end effect, the opening force or the force which acts in this connection is increased. The friction between the contact partners, namely the contact link and the contact, destroys nonconductive layers on the surfaces, with the result that cleaner contact is made because any oxide layers and/or layers of ice are broken up. In addition, the mass of the contact link can be reduced, with the result that there is a reduced tendency to bounce.

The invention also provides for the contact surface of the contacts to have fluting, which is preferably straight fluting or annular fluting, in order to achieve point touching contact.

The third alternative provides for the angle to be between 91° and 105°, preferably around 95°. The fourth alternative provides for the angle to be between 91° and 120°.

As regards the configuration of the edge of the contact link, provision is made for the edge to be bent or straight. The bent edge is particularly insensitive with respect to tolerances. This means that canting does not arise in practice in particularly material-saving embodiments.

In order to keep impact loading between the contact link and the contacts with which the contact link makes touching contact as low as possible, provision is made for, firstly, the contact link to be guided in a bearing by means of a pin and the contact link to have a region with the greatest cross section between the pin and the edge and a region with a reduced cross section between the region with the greatest cross section and the pin. This increases the bending elasticity.

In order to produce a transverse movement of the mutually touching contact faces on the contact link and the contact which is as effective as possible, provision is made for the contact link to comprise a central, flat section which is oriented perpendicular to the pin and which is adjoined by at least one outer flat section, pointing away from the pin. An angle which is not equal to 90° is provided between the central and the outer section. In order to achieve as good a holding capacity of the contact link as possible, provision is made for at least one of the two contacts to have a hardness which is less than a hardness of the contact link. Furthermore, provision is made for a coefficient of friction between the contact link and the at least one contact to have a value of between 0.1 and 2, preferably between 0.6 and 1. In order to achieve a particularly good scraping effect, provision is made for the edge to have a radius of less than 0.3 mm Furthermore, provision is made for the contact link to be a metal sheet which preferably has a sheet metal thickness of between 1 and 4 mm In the case of the third alternative, provision is made for that face of the contact link which points towards the contact to make contact with an edge of the contact.

For the case in which contact is made on the side of the contact link by means of an edge, provision is made for the contact link to have a plurality of edges which make contact with the contact. In order to optimize the contact link, provision is made for said contact link to comprise a plurality of layers. In this case, preferably one substrate layer is provided and one contact layer is provided attached to the substrate layer. Preferably, the substrate layer is intended to consist of a copper or silver alloy or steel or bronze or brass, while the contact layer is intended to consist of a copper, tin, gold or silver alloy or a metal-metal oxide composite material.

Provision is made for a starting device comprising an electromagnetic switch, as described. The switch is particularly advantageous insofar as it can be used very particularly in high-current applications, such as are present in starting devices, for reducing switching problems.

The invention also provides for either the contact link with its surface in the form of an edge to slide over the contact surface of the contact or the contact surface of the contact with its surface in the form of an edge to slide over the contact link. For the case in which a cohesive connection is produced between the contact link and a contact, provision is made for a sufficiently large shear force in the cohesive connection to detach said connection.

Furthermore, a method is provided with which the electromagnetic switch is switched. In this case, two contacts are connected by the one movable contact link. When the contact link makes contact with at least one of the two contacts, a scraping movement takes effect between the contact link and the contact surface of the contact. A scraping movement means that a sliding movement (frictional movement) takes effect between the contact link and the contact surface of the contact.

BRIEF DESCRIPTION OF THE DRAWINGS

The invention will be explained in more detail below by way of example with reference to the figures, in which.

DETAILED DESCRIPTION

Figure 1:
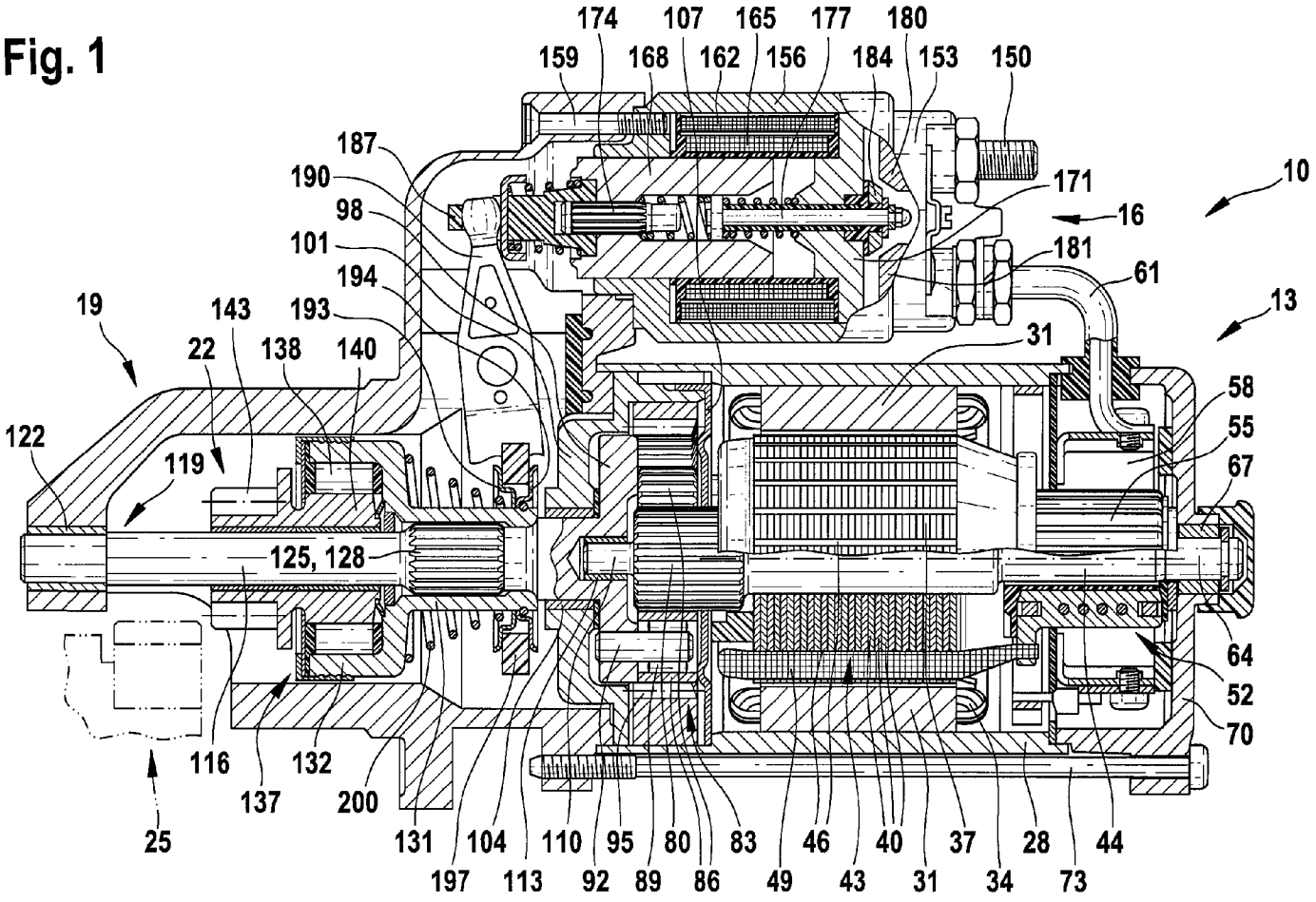
FIG. 1 shows a starting device in a longitudinal section.

FIG. 1 shows a starting device in a longitudinal section. FIG. 1 illustrates a starting device 10. This starting device 10 has, for example, a starter motor 13 and an electromagnetic switch 16, which is in the form of an engaging relay here. The starter motor 13 and the switch 16 are attached to a common input drive end plate 19. The starter motor 13 has the functional purpose of driving a starter pinion 22 when it is engaged in the ring gear 25 of the internal combustion engine (not illustrated here).

The starter motor 13 has, as housing, a pole tube 28, which bears pole shoes 31 on its inner circumference, said pole shoes each having a field winding 34 wound around them. Instead of being excited electrically, it is possible for the stator to be excited by permanent magnets. The pole shoes 31 in turn surround an armature 37, which has an armature stack 43 comprising laminates 40 and an armature winding 49 arranged in slots 46. The armature stack 43 is pressed onto an input drive shaft 44. Furthermore, a commutator 52 is fitted at that end of the input drive shaft 44 which is remote from the starter pinion 22, said commutator comprising, inter alia, individual commutator segments 55. The commutator segments 55 are electrically connected to the armature winding 49, in a known manner, in such a way that, when the commutator segments 55 are energized by carbon brushes 58, a rotary movement of the armature 37 results in the pole tube 28. A power supply line 61 arranged between the meshing relay 16 and the starter motor 13 supplies power to both the carbon brushes 58 and the field winding 34 in the switched-on state. The input drive shaft 44 is supported on the commutator side in a sliding bearing 67 with a shaft journal 64, said sliding bearing in turn being held fixed in position in a commutator bearing cap 70. The commutator cap 70 is in turn fixed in the input drive end plate 19 by means of tension rods 73, which are arranged distributed over the circumference of the pole tube 28 (screws, for example 2, 3 or 4 pieces). In the process the pole tube 28 is supported on the input drive end plate 19, and the commutator bearing cap 70 is supported on the pole tube 28.

In the input drive direction, the armature 37 is adjoined by a so-called sun gear 80, which is part of a planetary gear mechanism 83. The sun gear 80 is surrounded by a plurality of plant gears 86, usually three planet gears 86, which are supported by means of roller bearings 89 on axle journals 92. The planet gears 86 roll in a hollow wheel 95, which is mounted externally in the pole tube 28. In the direction towards the output drive side, the planet gears 86 are adjoined by a planet carrier 98, in which the axle journals 92 are accommodated. The planet carrier 98 is in turn mounted in an intermediate bearing 101 and a sliding bearing 104 arranged therein. The intermediate bearing 101 is configured in the form of a pot in such a way that both the planet carrier 98 and the planet gears 86 are accommodated in said intermediate bearing. Furthermore, the hollow wheel 95 is arranged in the pot-shaped intermediate bearing 101 and is ultimately closed by a cover 107 with respect to the armature 37. The intermediate bearing 101 is also supported with its outer circumference on the inner side of the pole tube 28. The armature 37 has a further shaft journal 110 on that end of the input drive shaft 44 which is remote from the commutator 52, said shaft journal likewise being accommodated in a sliding bearing 113. The sliding bearing 113 is in turn accommodated in a central bore in the planet carrier 98. The planet carrier 98 is integrally connected to the output drive shaft 116. This output drive shaft 116 is supported by its end 119 remote from the intermediate bearing 101 in a further bearing 122, which is fixed in the input drive end plate 19. The output drive shaft 116 is divided into various sections: a section with a so-called straight gearing 125 (inner gearing) which is part of a so-called shaft-hub connection thus follows the section arranged in the sliding bearing 104 of the intermediate bearing 101. This shaft-hub connection 128 makes it possible in this case for a driver 131 to perform an axially linear sliding movement. This driver 131 is a sleeve-like protrusion, which is integral with a pot-shaped outer ring 132 of the freewheel 137. This freewheel 137 (ratchet) furthermore comprises the inner ring 140, which is arranged radially within the outer ring 132. Clamping bodies 138 are arranged between the inner ring 140 and the outer ring 132. These clamping bodies 138, in interaction with the inner and the outer ring, prevent a relative rotation between the outer ring and the inner ring in a second direction. In other words: The freewheel 137 enables a relative movement between the inner ring 140 and the outer ring 132 in only one direction. In this exemplary embodiment, the inner ring 140 is integral with the starter pinion 22 and the helical gearing 143 (outer helical gearing) thereof.

Figure 2:
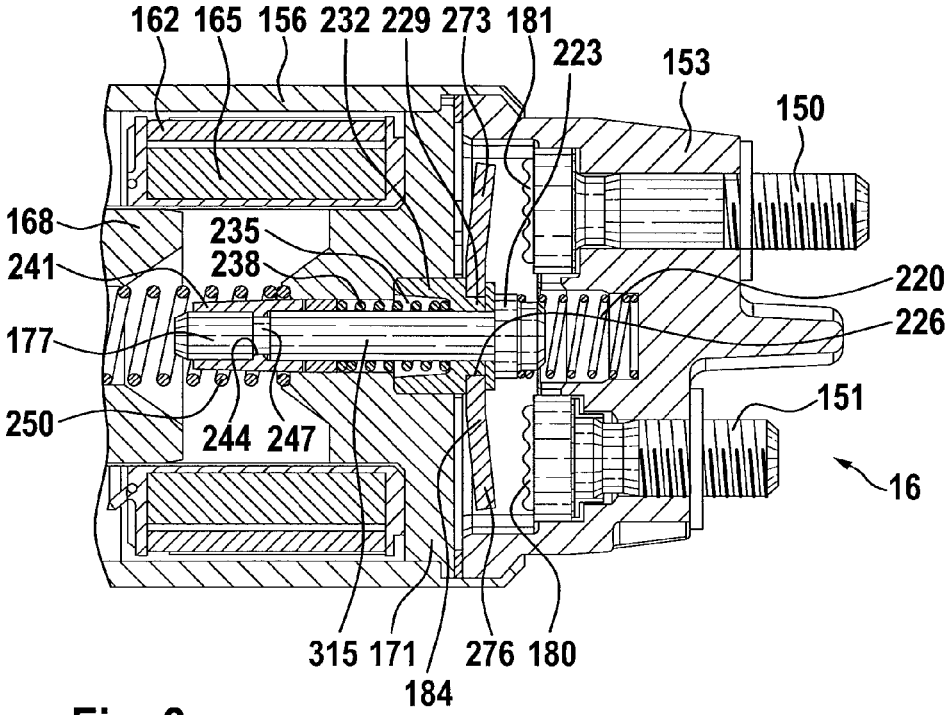
FIG. 2 shows a longitudinal section through the electromagnetic switch in accordance with a first exemplary embodiment.

For reasons of completeness, details are also given here on the meshing mechanism (FIG. 1 and FIG. 2). The switch 16 has a pin 150, which bears an electrical contact 181 and is connected to the positive terminal of an electrical starter battery (not illustrated here). This pin 150 as well as a pin 151 is passed through a relay cover 153. This relay cover 153 seals off a relay housing 156, which is fastened to the input drive end plate 19 by means of a plurality of fastening elements 159 (screws). A pull-in winding 162 and a so-called hold-in winding 165 are furthermore arranged in the switch 16. The pull-in winding 162 and the hold-in winding 165 both each induce an electromagnetic field in the switched-on state, said electromagnetic field flowing through both the relay housing 156 (consisting of electrically conductive material), a linearly movable armature 168 and an armature magnetic return path 171. The armature 168 bears a push rod 174, which is moved in the direction of a switching pin 177 during linear pull-in of the armature 168. With this movement of the push rod 174 towards the switching pin 177, said switching pin is moved out of its rest position in the direction towards the contact 181 and a contact 180, with the result that a contact link 184, which is fitted at that end of the switching pin 177 which faces the contacts 180 and 181, electrically connects the two contacts 180 and 181 to one another. As a result, electrical power is passed from the pin 150, beyond the contact link 184 and the pin 151, to the power supply line 61 and therefore to the carbon brushes 58. The starter motor 13 is energized in the process.

However, the switch 16 and the armature 168 furthermore also have the task of moving, with a pull element 187, a lever which is arranged in rotationally movable fashion on the input drive end plate 19. This lever 190, usually in the form of a forked lever, engages with two "prongs" (not shown here) on its outer circumference around two disks 193 and 194 in order to move a driver ring 197 which is trapped between said disks towards the freewheel 137 counter to the resistance of the spring 200 and thereby to mesh the starter pinion 22 in the ring gear 25.

FIG. 2 shows, furthermore, a contact release spring 220, which pushes the contact link 184 back into its initial position with respect to the hold-in winding 165, once the power has been disconnected. The contact release spring 220 presses for this purpose against a flange 223, which rests on the switching pin 177. The contact link 184 has, in its center, a hole 226, with which the contact link 184 is supported on a sleeve section 229 of an axially movable guide collar 232. This guide collar 232 has a substantially cylindrical cavity 235 between its outer contour and the switching pin 177, with in turn a compression spring 238 being supported in said cavity. This compression spring 238 is supported on a snap-action sleeve 241 at that end of the switching pin 177 which faces away from the contact link 184, said snap-action sleeve being held fixed in position with snap-action elements 244 in a slot 247. A further compression spring 250 is effective around the snap-action sleeve 241 between the armature 168 and the armature magnetic return path 171.

Figure 3:
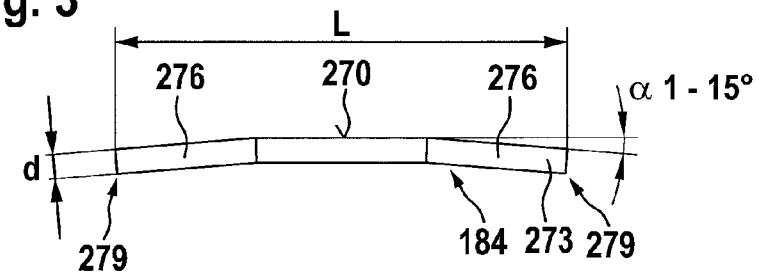
FIG. 3 shows a side view of a contact link.
Figure 4:
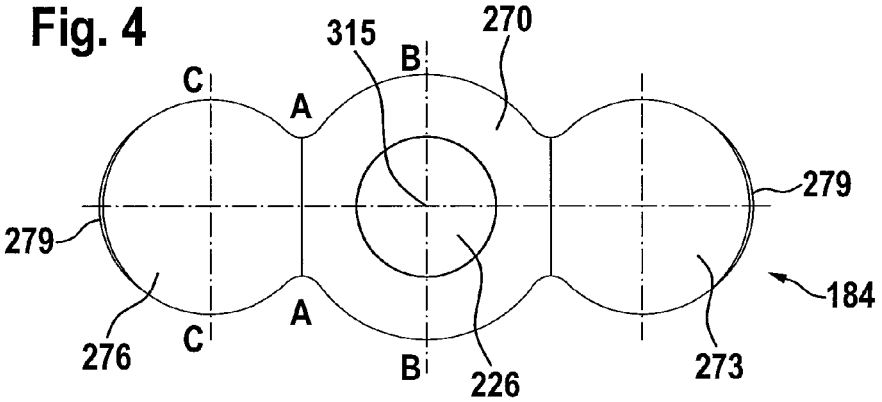
FIG. 4 shows a plan view of a contact link.

FIG. 3 shows a side view of the contact link 184. This contact link 184 shows a central, flat section 270, which has the hole 226 in its center (FIG. 4). This central, flat section 270, which is perpendicular to the switching pin 177, is adjoined by initially an outer, flat section 273, emerging outwards radially from the center of the hole 226 and therefore per se pointing away from the switching pin 177. A second outer, flat section 276 is arranged diametrically opposite this first outer, flat section 273. The two outer, flat sections 273 and 276 have an approximately circular contour. The two outer, flat sections 273 and 276 are deflected through an angle $\alpha$ with respect to the central, flat section 270. This angle $\alpha$ preferably has a value of between 1° and 15° with 5° being preferred. The outer, flat sections 273 and 276 have an edge 279 at the point thereof which is furthest removed from the center point of the hole 226.

Figure 5:
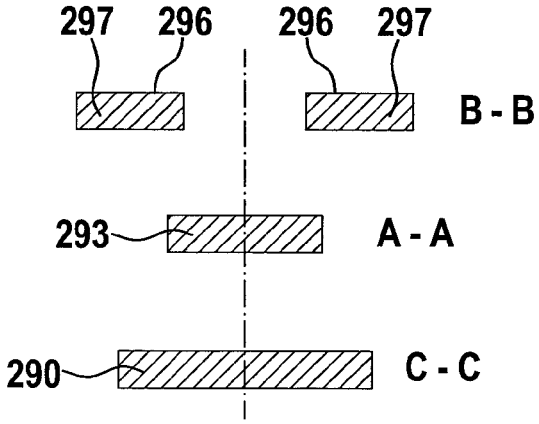
FIG. 5 shows three different cross sections of the contact link in accordance with the first exemplary embodiment shown in FIGS. 3 and 4.

A special exemplary embodiment for the contact link 184 provides for said contact link to consist of so-called electrical copper (E-Cu57). Furthermore, provision is made for the angle $\alpha$ to be equal to 5°, for the hardness of the material to be between 100 and 130 HV 10 (Vickers hardness test). 2 mm is provided for the material thickness d. The length L of the contact link 184 is selected such that contact is made between the edges 279 and the contacts 180 or 181. The rigidity of the contact link 184 is between 150 N/mm and 250 N/mm FIG. 5 shows three different cross sections of the contact link 184. The lower part in FIG. 5 shows the widest cross section 290 at the widest point on the outer, flat section 273. The central part in FIG. 5 shows the cross section 293 at the transition point between the outer, flat section 273 and the central, flat section 270. The contact link 184 is tapered at this point. The topmost region in FIG. 5 shows the cross section 296, which is divided into two subareas 297. The cross section B-B shows the cross section 296 which is at the widest point on the contact link 184 and is cut at the same time centrally through the hole 226. FIGS. 2, 3, 4 and 5 accordingly show that the contact link 184 is guided by means of a switching pin 177 in a bearing in the form of a guide collar 232 and the contact link 184 has a region with the greatest cross section 290 between the switching pin 177 and the edge 279 and a region with a reduced cross section 293 between the region with the greatest cross section 290 and the switching pin 177.

As regards the different cross sections 290, 293 and 297, provision is made in respect of the sum of the cross sections 297 for said cross sections to be greater than or equal to the cross section 293.

Figure 6:
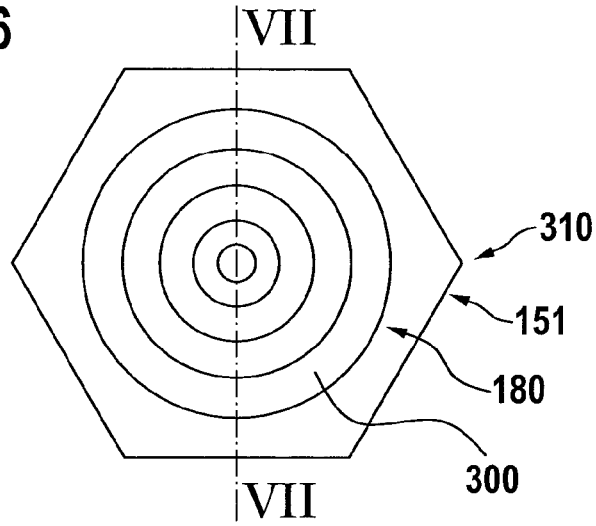
FIG. 6 shows a plan view of the contact of a pin.
Figure 7:
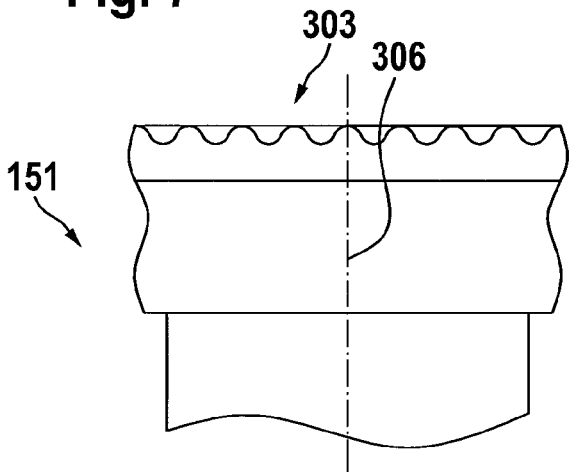
FIG. 7 shows a sectional illustration of a contact of a pin as shown in FIG. 6.

FIG. 6 shows a plan view of the contact 180 of the pin 151. As can be seen from said figure, the pin 151 illustrated therein is equipped with a contact 180, the contact surface 300 of which has fluting, which is annular fluting 310. This contact surface 300 or the fluting thereof is such that, as illustrated in FIG. 7, a corrugated contour results in cross-sectional view. This corrugated contour can be, for example, a sinusoidal profile or a similar profile with a corrugated configuration, i.e. one with "valleys and mountains". The fluting illustrated here is annular fluting 310, i.e. the corrugated contour 303 or the "mountains and valleys" thereof are oriented coaxially around the central line 306 of the pin 151 in the example.

Figure 8:
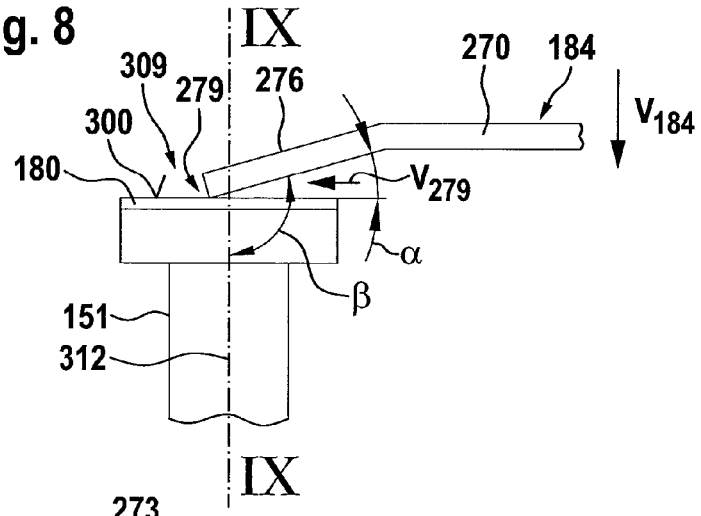
FIG. 8 shows a side view of a contact pin 151 and a contact link in accordance with a second exemplary embodiment.
Figure 9:
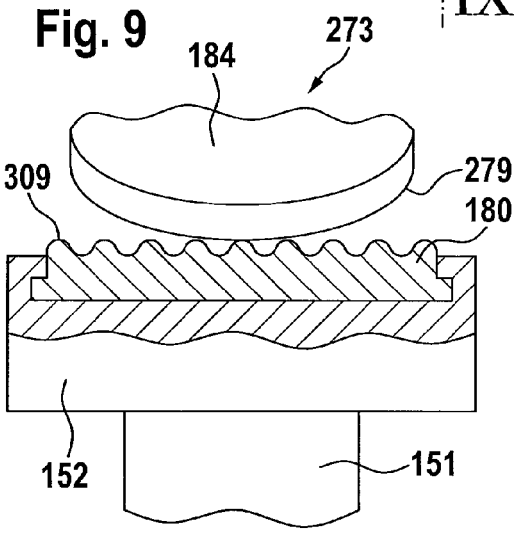
FIG. 9 shows a second side view of the second exemplary embodiment shown in FIG. 8.

In the context of the second exemplary embodiment, FIG. 8 and the subsequent figures, a contact link 184, as is known from FIG. 4, is paired with a contact pin 151, whose contact surface 300 does not consist of annular fluting 310, but of straight fluting 309, FIG. 8. The section line IX-IX drawn in FIG. 8 is illustrated in FIG. 9. Correspondingly, the section through the contact pin 151, the associated pin head 152 and the contact 180 are shown in said figure. As is illustrated therein in section, the straight fluting 309 on which the edge 279 of the contact link 184 is arranged is shown.

With reference to FIG. 8, it is illustrated therein how various sections are moved during switching, i.e. when contact is made between the contact link 184 and the contact 180. Thus, the arrow at the right-hand edge of FIG. 8 shows, denoted by $V_{184}$, the speed, i.e. the movement of the contact link 184 so as to produce the contact between the contact 180 and the contact link 184. Once the edge 279 has impinged upon the contact 180, the edge 279 is caused to move by the movement of the contact link 184 and the angle of inclination $\alpha$ between the outer, flat section 273 and the central, flat section 270 in a short movement in the direction of the arrow denoted $V_{279}$. With reference to FIG. 9, this means that the edge 279 will slide in the direction towards the observer on the straight fluting 209.

The first exemplary embodiment and also the second exemplary embodiment show an electromagnetic switch 16 for a starting device 10, wherein this electromagnetic switch 16 has two contacts 180 and 181, which can be electrically conductively connected to one another by a movable contact link 184. Provision is made here for at least one of the two contacts 180 and 181 to preferably have a contact surface 300 which is connected fixedly to a contact pin 151 or 150. In this case, the contact surface 300 has elevations, which preferably lie substantially in one plane. An electrical contact between the contact link 184 and the contact-making edge 279 of the contact link 184 is arranged in such a way that, when said edge impinges on the contact surface 300, it enables substantially multi-point touching contact between the contact 180, 181 and the contact link 184. Depending on the orientation of the straight fluting 309 or the relative position of the individual elevations of the straight fluting 309 with respect to the edge 279, initially also only single-point touching contact between the contact 180 or 181 and the contact link 184 is possible.

The straight fluting 309 is ideally intended to be in the form of sinusoidal longitudinal fluting. As regards the interaction between the contact 180 or 181 and the contact link 184, the intention is for the hardness of the contact 180 or 181 to be less than or equal to the hardness of the contact link 184. This is intended to ensure that it is not the contact link 184 but the contacts 180 and 181 which are subject to wear.

Figure 10:
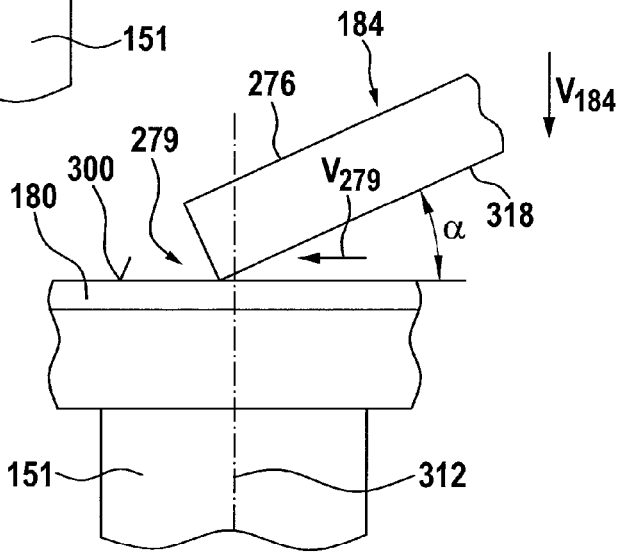
FIG. 10 shows a side view of a third exemplary embodiment.

FIG. 10 shows a third exemplary embodiment comprising a contact link 184, as is known from FIG. 4, and a contact 180, whose contact surface 300 is at least substantially planar. The contact link 184 moves correspondingly, as in the exemplary embodiment shown in FIG. 8. That is to say that the edge 279 moves transversely with respect to the longitudinal axis 312 illustrated of the contact pin 151. In this case, the edge 279 scrapes along the contact surface 300. When considered macroscopically, a linear shape is produced for the area of touching contact between the contact link 184 and the contact surface 300.

The exemplary embodiment shown in FIG. 10 shows, correspondingly, an electromagnetic switch 16 for a starting device 10 comprising two contacts 180, 181, which are electrically conductively connected to one another by a movable contact link 184, at least one of the two contacts 180 or 181 preferably having a contact surface 300 which is fixedly connected to a contact pin 151. In this case, provision is made for the contact surface 300 to be at least substantially planar and for an edge 279 of the contact link 184, said edge making electrical contact between the contact link 184 and the contact 180, 181, to be arranged in such a way that, once said edge has impinged upon the contact surface 300, it enables substantially linear touching contact between the contact 180, 181 and the contact link 184.

With reference to FIG. 8, a further definition for the way in which, as is the case here, the contact link 184 and the contact 180 or the contact 180 and the outer, flat section 276 are oriented relative to one another can be cited. Thus, an angle $\beta$ can be specified between the outer, flat section 276 and the longitudinal axis 312 of the contact pin 151, said angle lying in a plane, for example, which is formed by the longitudinal axis 312 and the central axis of the hole 226 (FIG. 4). This central axis of the hole 226 is denoted by 315 and is covered by the movement axis of the switching pin 177 (see also FIG. 2).

In accordance with this definition, an electromagnetic switch 16 for a starting device 10 is provided comprising two contacts 180 and 181, which are electrically conductively connected to one another by a movable contact link 184, at least one of the two contacts 180 or 181 preferably having a contact surface 300 which is fixedly connected to a contact pin 151, 150, wherein a face 318 of the contact link 184, said face pointing towards the contact 180, and a longitudinal axis 312 of a contact pin 151 enclose between them an angle $\beta$ which points towards a central axis 315 of the switch 16 and is greater than 90°. This definition applies to the rest position or up to the position of the switching link 184, in which the contact link 184 is just not in touching contact with the surface 300 or is in touching contact therewith out any force. As regards the angle $\beta$, provision is made for this angle to be between 91° and 105°, preferably around 95°.

Figure 11:
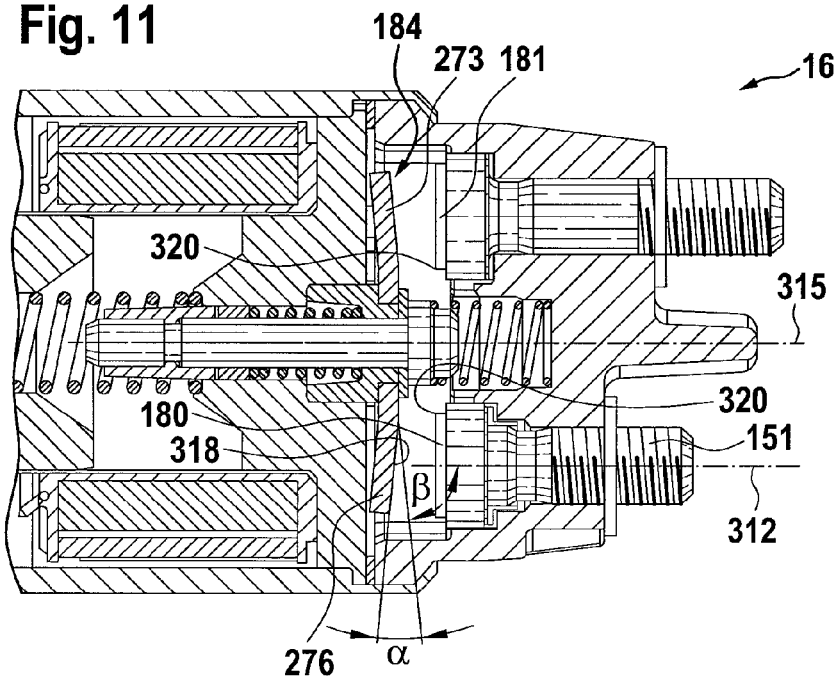
FIG. 11 shows a fourth exemplary embodiment of a switch with a different position of the contact link.

FIG. 11 shows a fourth exemplary embodiment of a switch 16. Since the details of the switch shown in FIG. 11 differ from those of the switch shown in FIG. 2 merely in terms of a few details, only the differences will be mentioned below.

While the contact link 184 shown in FIG. 2 has outer, flat sections 276 or 273, which are inclined or bent in the direction towards the contacts 180 and 181, the outer, flat sections 276 and 273 of the contact link 184 are not inclined with respect to the contacts 180 and 181, but are inclined away therefrom. Correspondingly, the angle of inclination α has a different mathematical sign in comparison with the exemplary embodiment shown in FIG. 2 and the central, flat section 270. The angle β is in this case defined as an angle which is arranged between that face 318 of the contact link 184 which points towards the contact 180 and a longitudinal axis 312 of a contact pin 151. The angle β is in this case oriented in such a way that it lies in a plane which is formed from the longitudinal axis 312 and the central axis 315. In this case, the angle β points radially outwards and is greater than 90°. As regards the angle β, provision is made for said angle to be between 91° and 120°. These cited values also relate to the position of the contact link 184 in the rest position or before it touches the contact surface 180. In the example shown in FIG. 11, the contacts 180 and 181 are configured, for example, in such a way that they have an edge 320 which, from the moment the contact link 184 impinges on the contact surface 300, causes a relative movement transverse to the central axis 315 between the contact link 184 and the contact 180 or 181. In this case, an edge 320 of the contact 180 or 181 scrapes against the contact link 184.

As regards the angle α, provision is made for this angle to have a value of between −1° and −30°. The angle is in this case selected depending on the coefficient of friction between the contact partners. For the case in which there is a high coefficient of friction the angle can tend to be smaller, while the angle tends to be larger at low coefficients of friction.

Figure 12:
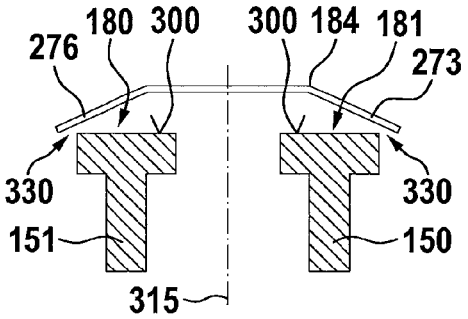
FIG. 12 shows a basic illustration of a fifth exemplary embodiment as a modification of the exemplary embodiment shown in FIG. 2.

The fifth exemplary embodiment shown in FIG. 12 shows a basic illustration of two contact pins 150 and 151, which are oriented with their contact surfaces 300 towards the outer, flat sections 273 and 276. The length of the contact link 184 transverse to the central axis 315 is in this case greater than the outermost distance between the two contact pins 151 and 150. The outer, flat sections 273 and 276 therefore do not scrape with one of their edges against the surfaces 300 of the contact pins 150 and 151. In this case the contact link 184 switches against sharp edges 330 of the contacts 180 and 181.

Figure 13:
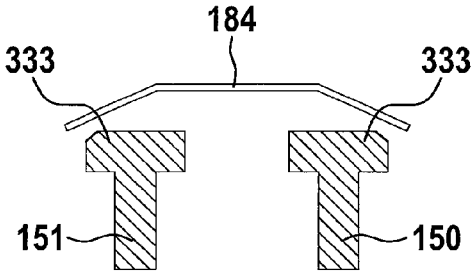
FIG. 13 shows a sixth exemplary embodiment of a pair of contact pins with a contact link.

As a modification of the exemplary embodiment shown in FIG. 12, the contact link 184 shown in FIG. 13 does not switch against the outermost edges of the contact pins 151 and 150, but rather against bent-back edges 333.

Figure 14:
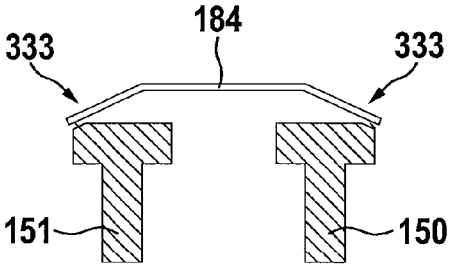
FIG. 14 shows a seventh exemplary embodiment of a pair comprising a contact link and contact pins.

FIG. 14 shows a seventh exemplary embodiment of a pair of a contact link 184 and a contact pin 151 and 150. This seventh exemplary embodiment is a modification of the exemplary embodiment shown in FIG. 13 and differs from this in that: the contact link 184 no longer protrudes beyond the outermost contours of the two contact surfaces 300 and the contact pins 151 and 150. In this case, too, the contact link 184 switches against a bent-back edge 333 of the contact pins 150 or 151.

Figure 15:
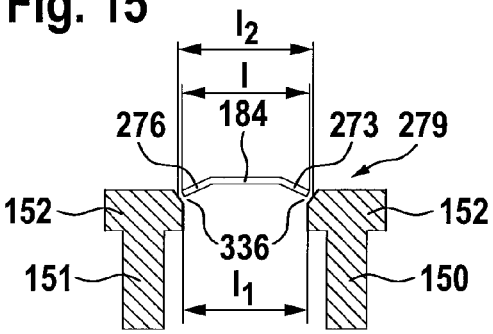
FIG. 15 shows an eighth exemplary embodiment of a pair comprising a contact link and two contact pins, FIG. 16 and FIG. 17 each show an alternative exemplary embodiment of a contact link.

FIG. 15 shows a further, eighth exemplary embodiment of a pair comprising a contact link 184 and two contact pins 150 and 151. The two contact pins 151 and 150 have two bevels 336 in the region of their pin heads 152, pointing towards one another. These two bevels 336 point substantially towards one another, but are not parallel to one another. A contact link 184 is provided, whose length is shorter than the greatest distance between the bevels 336, but greater than the smallest distance between the two bevels 336. In this exemplary embodiment, an edge 279 of the outer, flat sections 273 and 276 scrape against the bevels 336.

Figure 16:
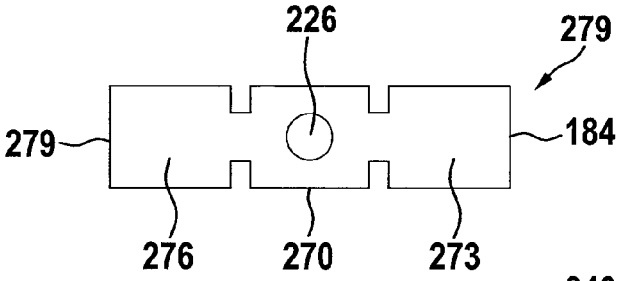

FIG. 16 shows a contact link 184 in a further alternative exemplary embodiment. This contact link also has a central, flat section 270 and two outer, flat sections 273 and 276. The central, flat section 270 likewise has, in its center, a hole 226. The edges 279, in contrast to, for example, the exemplary embodiment shown in FIG. 3 and FIG. 4, are not round but straight. The outer, flat sections 273 and 279 are likewise shown, similar to the exemplary embodiment shown in FIG. 3 and FIG. 10, with an angle α with respect to the central, flat section 270.

Figure 17:
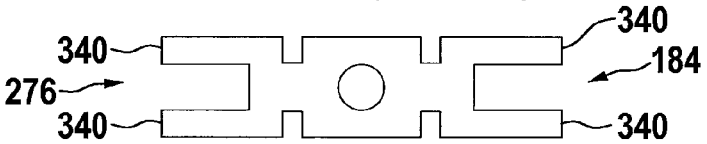

As an alternative to the embodiment shown in FIG. 16, as illustrated in FIG. 17, the contact link 184 can have two outer, flat sections 273 and 276, which, in contrast to the exemplary embodiment shown in FIG. 16, are provided with slits in such a way that the respective flat sections are in the form of two lugs 340. Instead of the term lugs, the term sheet-metal lobes would also be suitable, for example.

Figure 18A:
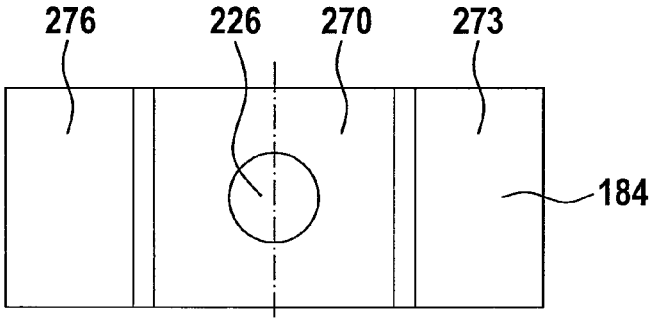
FIG. 18 and FIG. 19 show two further alternatives for contact links.
Figure 18B:
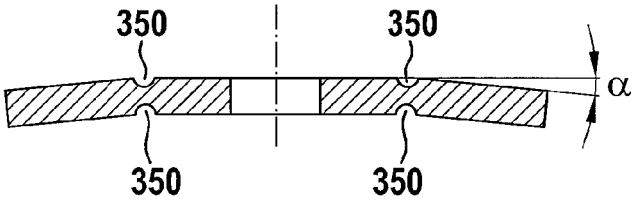

FIG. 18 shows a contact link 184, which is substantially rectangular. In turn, said contact link has a central, flat section 270 and two outer, flat sections 276 and 273. In turn, a hole 226 is arranged centrally in the flat section 270. While FIG. 18*a* shows a plan view, FIG. 18*b* shows a sectional view of the contact link 184. This sectional view shows the way in which the outer, flat sections 273 and 276 are bent back through the angle α. In order to influence or increase the flexibility of the outer, flat sections 273 and 276, said sections are connected to the central, flat section 270 via notches 350. The notches, as in the example here, can be arranged on both sides of the face of the contact link 184, but can also alternatively be on one side. These notches 350 are in this case in the form of semi-circular beads for reducing the cross section and reducing the bending strength of the contact link 184.

Figure 19A:
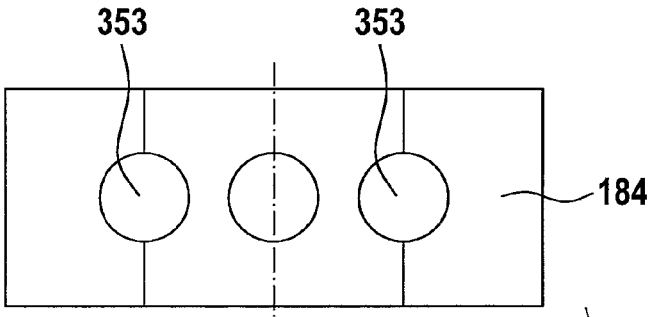
Figure 19B:
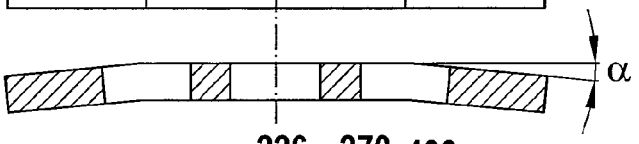

As shown in the illustration in FIGS. 19*a* and 19*b*, a further contact link 184 is illustrated in a plan view and a sectional illustration. The constrictions for reducing the cross section or reducing the bending strength of the contact link 184 do not need to be introduced into the outer contour, as is illustrated in FIG. 18. It is also possible for cutouts to be introduced into the preferably rectangular contact link 184. FIG. 19 shows, by way of example, two circular cutouts 353, which reduce the cross section. The cutouts can have any desired shape, for example they can be rectangular or rounded off.

Figure 20:
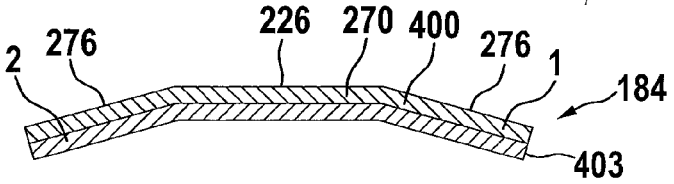
FIG. 20 shows a sectional illustration of a contact link, of which a basic illustration is shown here.

FIG. 20 shows a contact link 184 in longitudinal section. This contact plate has, in turn, a central, flat section 270 and two outer, flat sections 273 and 276. The central, flat section 270 has, in turn, a hole 226, as do the preceding exemplary embodiments for contact links 184. This contact link 184 comprises a plurality of layers. A first layer is a substrate layer 400 and a second layer attached to this substrate layer 400 is a contact layer 403. In the case of this contact link 184, the properties are optimized by forming the contact link 184 from a plurality of layers. Thus, the first layer, namely the substrate layer 400, has favorable properties as a holding element imparting stability and elasticity. On the other hand, the contact layer 403 has optimized properties in terms of contact-making between the contact link 184 and the contact 180 or 181. Provision is made for the substrate layer 400 to consist of a copper or silver alloy or steel or bronze or brass. For the contact layer 403, provision is made for said layer to consist of a copper, tin, gold or silver alloy or a metal-metal oxide composite material.

For the contacts 180 and 183 of the contact pins 151 and 150, respectively, it is generally intended for said contacts to likewise consist of electrical copper and to have a hardness of between 100 and 130 HV10.

By virtue of the shape of the contact link 184, for example as shown in FIG. 4 ("constriction"), FIG. 16, FIG. 17, FIG. 18 and FIG. 19, the spring stiffness is reduced with respect to previously known contact links. This results in increased elastic deformation when the contacts 180 and 181 are connected with the above-described advantages of increased damping and the destruction of an oxide layer which has been produced.

As regards the edges 279 and 320, provision is made for said edges to have a radius of <0.3 mm This results in a "chisel effect", so that the edges 279 and 320 remove disruptive layers during respectively opposite contact. Contact-making properties are thus considerably improved. In the region of the edges 279 and 320, in this case an areally or linearly very small cohesive connection is preferably produced owing to switch-on arcs. By virtue of these cohesive connections being ripped open, the respective edge 279 or 320 is resharpened repeatedly, as a result of which characteristics or point contact between the edge and the mating contact remain even after repeated switching. The edges 279 and 320 also have the advantage that layers of ice which are formed on the contacts 180 and 181 in the switch as a result of any moisture in the air are broken through.

As regards the material thickness of the contact link 184, provision is generally made for the corresponding metal sheet to preferably have a thickness of between 1 and 4 mm Furthermore, a method for switching an electromagnetic switch 16 is provided, wherein said electromagnetic switch has two contacts 180 and 181, which are connected by a movable contact link 184. When contact is made between the contact link 184 and at least one of the two contacts 180 and 181, a scraping movement takes effect between the contact link 184 and the contact surface 300 of the contact 181 or 180. Either the contact link slides with its surface in the form of an edge 279 over the contact surface 300 of the contact 180 or 181 or the contact surface 300 of the contact 180 or 181 slides with its surface shape of an edge 320 over the contact link 184. Any cohesive connection between the contact link 184 and the contacts 180 and 181 is intended to be detached in the release case by shear force loading in the cohesive connection (welding).

The edge 279 serves the purpose of scraping or chafing on the surface of the contacts 180 and 181, thereby producing friction and ultimately converting energy. The energy to be converted is the energy from the movement of the contact link 184 and the parts which are moved during the switching operation, for example the switching pin 177, the snap-action sleeve 241, the compression spring 238, the guide collar 232, the flange 223. This movement energy will be dissipated by the friction of the contact link 184 on the contacts 180 and 181 to such an extent that the contact link 184 substantially no longer bounces back and thus the tendency to form arcs between the contacts 180 and 181 and the contact link 184 is at least considerably reduced.

Figure 21:
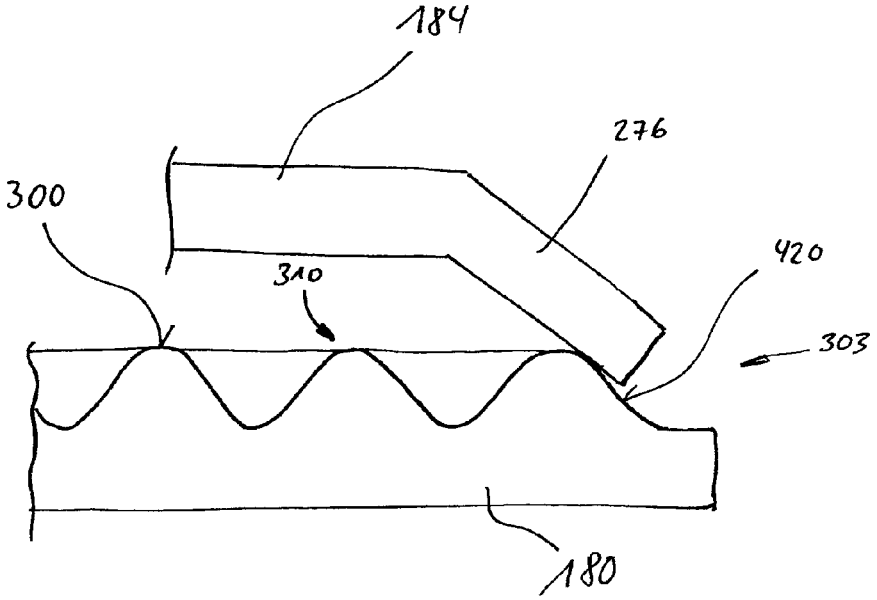
FIG. 21 shows a side view or sectional illustration of a further particularly advantageous combination of contact link and contact surface.

FIG. 21 shows a side and a sectional view of the contact link 184, which produces an electrical connection with the contact 180 of the pin 151. As can be seen from said figure, the contact 180 or the contact surface 300 thereof has fluting, which is annular fluting 310. This contact surface 300 or the fluting thereof is such that, in the cross-sectional view, a corrugated contour is produced. This corrugated contour can, for example, be a sinusoidal profile or a similar profile with a corrugated shape, i.e. one with "valleys and mountains" (see also FIG. 6). The fluting illustrated here is annular fluting 310, i.e. the corrugated contour 303 or the "mountains and valleys" thereof are oriented coaxially around the central line 306 of the pin 151 in the example. Provision is made for the contact link 184 to slide or rub with its outer, flat section 276 along a flank 420 of the corrugated contour 303 when switching or when contact is made.

Figure 22A:
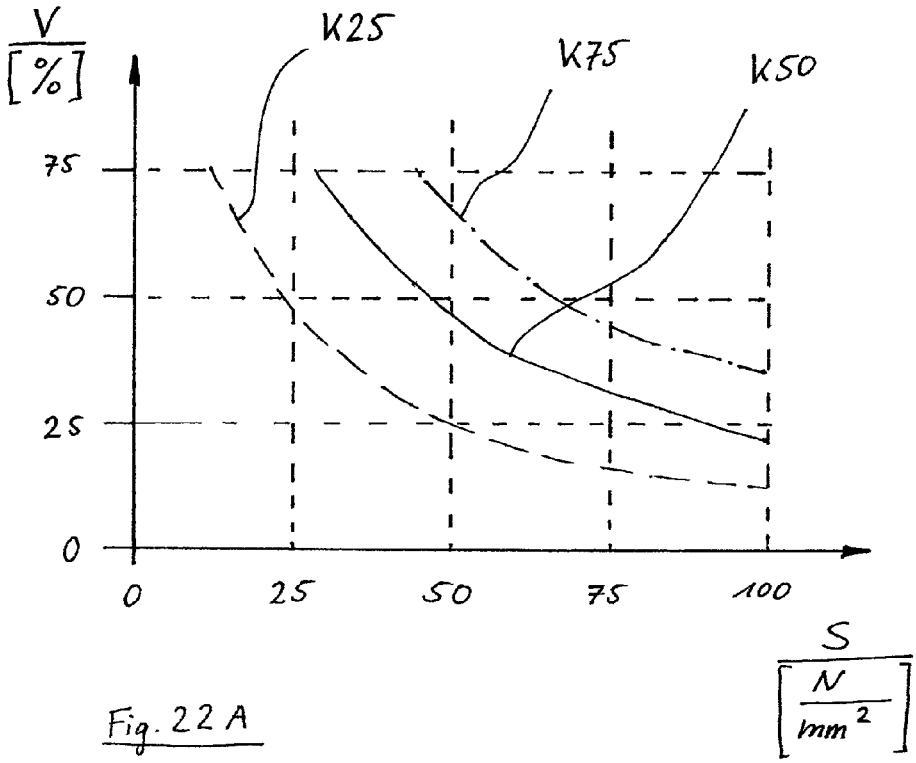
FIG. 22A shows a graph illustrating the dependencies of various parameters.
Figure 22B:
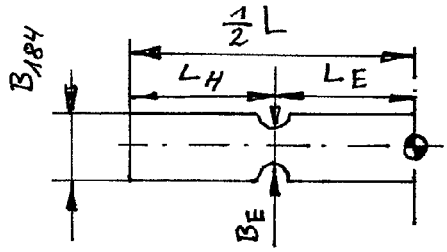
FIG. 22B shows half a contact link with different dimensions of significance for FIG. 21A.

FIG. 22A shows a graph, which illustrates the bending stress in the constricted region depending on a constriction ratio and a lever arm ratio. The constricted region is in this case the region of the contact link 184 which corresponds to the tapered cross section 293 illustrated in FIG. 5. In principle, this applies to all of the contact links 184 with a reduced cross section, as is also illustrated in FIGS. 16 to 19, for example. The three curves K25, K50 and K75 illustrated there represent different parameters. Curve K25 represents a lever arm ratio of 25%, K50 represents a lever arm ratio of 50%, K75 represents a lever arm ratio of 75%. "Lever arm ratio" means that, with reference to FIG. 22B, a ratio of LH/L=1/4=25%. The greater the lever arm ratio, the greater the stress S in cross section 293 is given the same force loading. Furthermore, the constriction ratio V is taken into consideration. V is the quotient of the width BE with respect to the width B 184. In order to avoid or prevent contact bounce and to convert this into a frictional or sliding movement, provision is made for the bending stress S in cross section 293 to be greater than 20 $N/mm^2$ Furthermore, the bending stress S should be less than 100 $N/mm^2$ For the constriction ratio V, it is desirable for this ratio to be less than or equal to 75%, preferably greater than 25%. A ratio of between 70% and 35% has proven to be particularly favorable.

The invention claimed is:

1. An electromagnetic switch (16) for a starting device (10), comprising two contacts (180, 181) that are electroconductively interconnected by a mobile contact link (184) that moves along a movement axis of a switching pin (177) and has a contact edge (279) and a central flat section (270) with a hole (226), wherein at least one of the two contacts (180, 181) comprises a contact surface (300) fixed to a contact pin (150, 151) having a longitudinal axis (312) that is a central axis of the contact pin (150, 151), characterized in that the contact surface (300) has fluting in the shape of an annular fluting (310) and an outer flat section (276) of the contact link (184) glides or rubs along a surface (420) of a wave-like contour (303) of the annular fluting (310) during a switching operation or, respectively, when providing contact, and wherein the outer flat section (276) has a face (318) that points toward the contact surface (300), and wherein during a switching operation there is a current passage area, with the longitudinal axis (312) being disposed between the current passage area and the movement axis of the switching pin (177), and with the current passage area being disposed between the contact edge (279) and the longitudinal axis (312), and further wherein an angle (β) of greater than 90 degrees exists between the face (318) and the longitudinal axis (312) and points toward a central axis (315) of the switch (16).

2. The electromagnetic switch according to claim 1, characterized in that the central flat section (270) is oriented perpendicular to the switching pin (177) and wherein the outer flat section (276) is adjoined to the flat section (270) so as to point away from said switching pin (177), wherein the outer flat section (276) is inclined or bent in a direction of the contacts (180, 181).

3. The electromagnetic switch according to claim 1 , characterized in that the contact link (184) is guided in a bearing by means of the switching pin (177) and said contact link (184) has a region comprising an enlarged cross-section (290) between the switching pin (177) and the edge (279) of the contact link (184) and has a region of reduced cross-section (293) between the region comprising the enlarged cross-section (290) and the switching pin (177).

4. The electromagnetic switch (16) according to claim 1, characterized in that a necked-down portion is present between the central flat section (270) and the outer flat section (276).

5. The electromagnetic switch (16) according to claim 1, characterized in that the outer flat section(276) has an approximately circular contour.

6. The electromagnetic switch according to claim 1, characterized in that the wave-like contour (303) has a sinusoidal form.

* * * * *